US006564885B2

(12) United States Patent
Attwater

(10) Patent No.: US 6,564,885 B2
(45) Date of Patent: May 20, 2003

(54) UP-HOLE OVERSHOT AND SAFETY DRILLING APPARATUS

(75) Inventor: Michael O. Attwater, North Bay (CA)

(73) Assignee: Boart Longyear International Holdings, Inc., Salt Lake City, UT (US)

( * ) Notice: Subject to any disclaimer, the term of this patent is extended or adjusted under 35 U.S.C. 154(b) by 84 days.

(21) Appl. No.: 09/845,060

(22) Filed: Apr. 27, 2001

(65) Prior Publication Data

US 2002/0157872 A1 Oct. 31, 2002

(51) Int. Cl.[7] ..... E21B 25/00
(52) U.S. Cl. ..... 175/235; 166/98
(58) Field of Search ..... 166/98; 175/162, 175/231, 234, 235, 232, 257, 243; 294/86.26, 86.28, 86.33

(56) References Cited

U.S. PATENT DOCUMENTS 3,120,282 A * 2/1964 Pickard ..... 175/214
3,120,283 A 2/1964 Braun
3,667,558 A * 6/1972 Lambot ..... 175/236
5,592,994 A * 1/1997 Laporte et al. ..... 175/247

* cited by examiner

*Primary Examiner*—Robert E. Pezzuto
*Assistant Examiner*—Meredith C. Petravick
(74) *Attorney, Agent, or Firm*—Clayton R. Johnson

(57) ABSTRACT

The drilling apparatus includes a safety sub mountable to the drill string outer end to retain the combination of an overshot assembly and an overshot adaptor extending within the drill string outer end during a drilling operation and preventing the drilling tool moving out of the drill string until the sub is removed. The overshot assembly has a fluid seal between the overshot tube and the drill string and a fluid bypass channel with/a valve for blocking axial outward flow through the channel when the overshot adaptor is separated from the overshot assembly and when connected thereto, retaining the valve in an open condition. When the overshot adaptor is removed from the overshot assembly, the overshot assembly is fluidly propellable to the bit end. A disconnect tool facilitates the removal of the adaptor from the sub.

24 Claims, 5 Drawing Sheets

UP-HOLE OVERSHOT AND SAFETY DRILLING APPARATUS

BACKGROUND OF THE INVENTION

This invention relates to overshot and safety apparatus for retracting a core barrel inner tube assembly and mechanism to decrease the chances of unintended movement of the inner tube assembly outwardly of the drill string which can result in injury to personnel during up-hole drilling (drilling is at a hole angle that is above the horizontal).

During up-hole drilling with wire line equipment, the inner tube assembly can unexpectly move to and through the outer end of the drill string and injure someone. For example, if the inner tube assembly is not properly maintained, it is possible the inner tube assembly can move to the outer end of the drill string in an uncontrolled manner. To stop such outward movement of an inner tube assembly or the like, it is necessary to consider connecting a device such as a "safety sub" at the outer end portion of the drill sting. A sub is usually a short coupling having male and female thread connections. Such a sub can have a closed end or have a minimum inner diameter portion that is of a small inner diameter than the maximum outer diameter of the outer end portion of the drilling tool that is used in the drill string, for example, a core barrel inner tube assembly or an overshot assembly.

A problem with such a safety sub is that it must be removed from the outer end of a drill string in order to insert a prior art overshot assembly in the drill string preparatory to retrieving a core barrel inner tube assembly when it is filled with core. In removing the sub from the drill string, in order to be able to insert a wire line overshot assembly, the operator is exposed to the open outer end of the drill string through which the drilling tool in the drill string may move outwardly in a dangerous manner whereby the operator is exposed to possible injury when the drilling direction is upwardly. After the overshot assembly is pumped to the inner end of the drill string and then attempting to unlatch (uncouple) the inner tube assembly from its latched condition in the drill string, it is possible to have a mistaken unlatched or a "hung-up" inner tube assembly whereby the overshot assembly is retracted without the inner tube assembly coupled thereto. Again, the operator is exposed to possible injury from the drilling tool if and when it unexpectly moves out of the outer end of the drill string.

In U.S. Pat. No. 3,120,283 to Braun there is disclosed an underground overshot assembly (see FIGS. 10 and 11) that is fluidly propellable to the bit end of the drill string regardless of the drilling direction. The overshot assembly includes a main body pivotally mounting pulling dogs and a valving subassembly that provides an open fluid bypass channel when being retracted though the drill string.

In order to make improvements in overshot and safety apparatus that is particularly usable in up-hole drilling (a drilling direction above the horizontal), this invention has been made.

SUMMARY OF THE INVENTION

The overshot assembly includes a main body mounting pulling dogs for movement between an inner tube assembly coupling position and a release position, an annular seal for forming a fluid seal with the interior of a drill string, an elongated overshot tube joined to the main body and valving mechanism resiliently urged to block axial outward flow through the overshot tube. A safety sub is removably mounted to the outer end portion of the drill string while an overshot adaptor is removably mounted to sub to prevent the overshot assembly moving inwardly of the sub and to retain overshot valving mechanism in an open condition. The overshot adaptor includes valving mechanism to permit fluid to be pumped inwardly through the overshot adaptor and the overshot tube and block fluid flow in the opposite direction, the combination of the overshot assembly and overshot adaptor being axially slidably movable a limited amount relative to the sub. When it is desired to retract an inner tube assembly or other drilling tool, the water swivel is removed from the drill string and a disconnect tool is used to pull the overshot adaptor to extend outwardly in the sub. Now the overshot adaptor is unthreaded from the overshot assembly. Then a wire line adaptor is threaded to the overshot tube to close the outer end thereof and a loading chamber is threaded to the sub and fluid under pressure is pumped into the sub for forcing the overshot assembly inwardly.

One of the objects of this invention is to provide new and novel overshot means for use in up-hole drilling apparatus that is usable in combination with a safety sub to minimize danger when a drill tool is in a drill string during up-hole drilling and the outer end of the drill string is opened. Another object of the invention is to provide new and novel overshot and safety apparatus that is retained at the outer end of a drill string while a bore hole is being drilled. In furtherance of the last mentioned object, it is another object of this invention to provide new and novel adaptor means to cooperate with a safety sub and a new and novel up-hole overshot assembly to retain the overshot assembly adjacent to the outer end of a drill string while permitting fluid under pressure being pumped through the overshot assembly when drilling with a core barrel inner tube assembly. An additional object is to provide new and novel overshot means that is fluidly propellable in a drill string in an upward direction when connected to wire line means and block axial outward fluid flow therethrough when disconnected from such wire line means and not mechanically retained in an unblocked fluid flow position.

For purposes of facilitating the description of the invention, the term "inner" refers to that portion of the drill string, or of the assembly, or an element of the assembly being described when, in its position "for use" in, or on, the drill string is located closer to the drill bit on the drill string (or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element of the assembly being described when, in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

DETAILED DESCRIPTION OF THE INVENTION

Figure 1A:
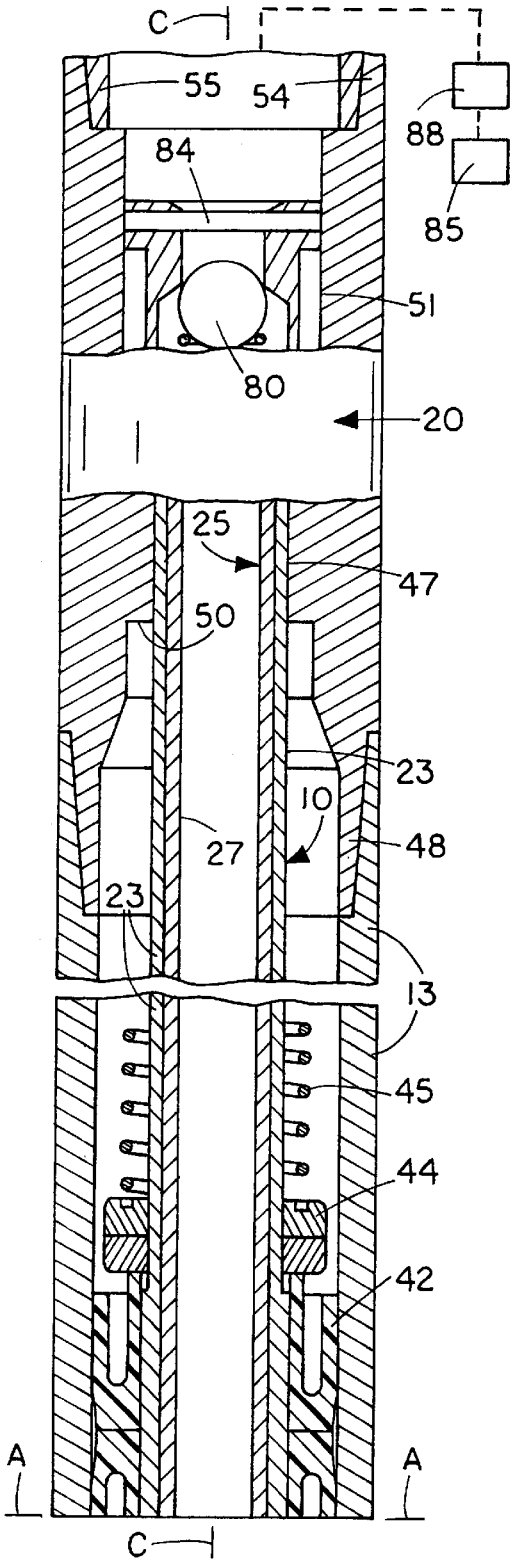
FIGS. 1A and 1B, when arranged one above the other with their axial center lines aligned and lines A—A and B—B of FIGS. 1A and 1B aligned, other than for a part adjacent to the outer end, form a composite longitudinal section through the drilling apparatus of this invention with the safety sub and overshot adaptor retaining the overshot assembly at the outer end of the drill string and an axial intermediate portion is broken away.
Figure 1B:
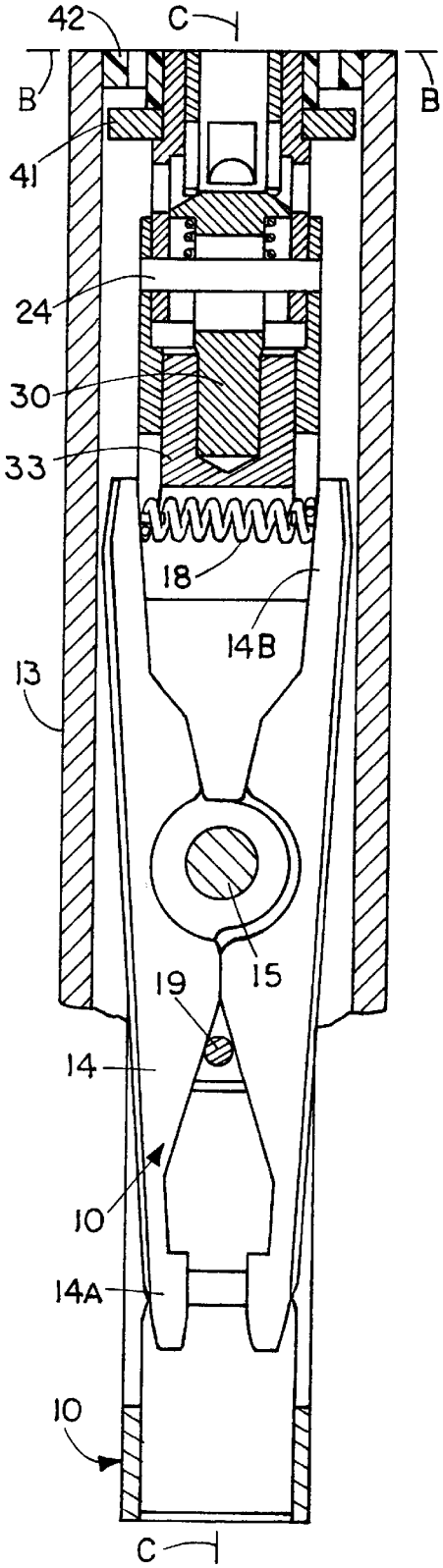
Figure 6:
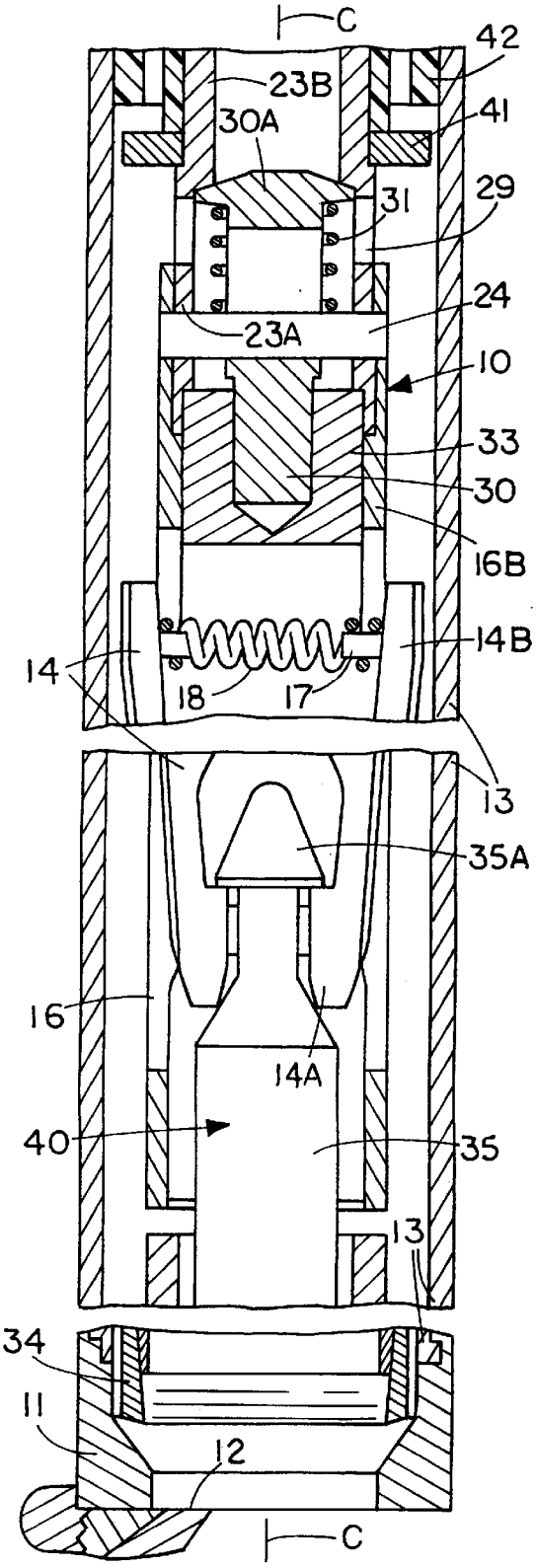
FIG. 6 is an enlarged longitudinal view of the inner end portion of the overshot assembly with the overshot adaptor removed therefrom and coupled to a wire line core barrel inner tube assembly, an axial intermediate part of the overshot assembly being broken away and only the axial opposite end portions of the core barrel inner tube assembly being shown.
Figure 7:
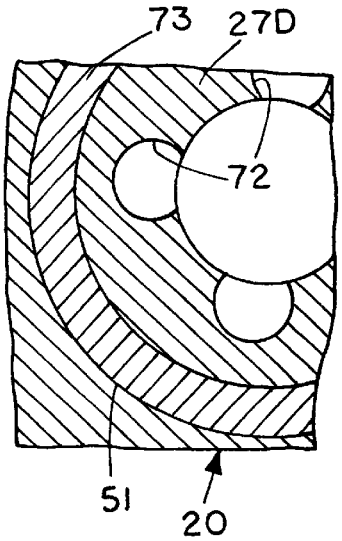
FIG. 7 is a fragmentary transverse cross sectional view of the safety sub, the overshot adaptor and the overshot assembly, said view being generally taken along the line and in the direction of the arrows 7—7 of FIG. 2.
Figure 8:
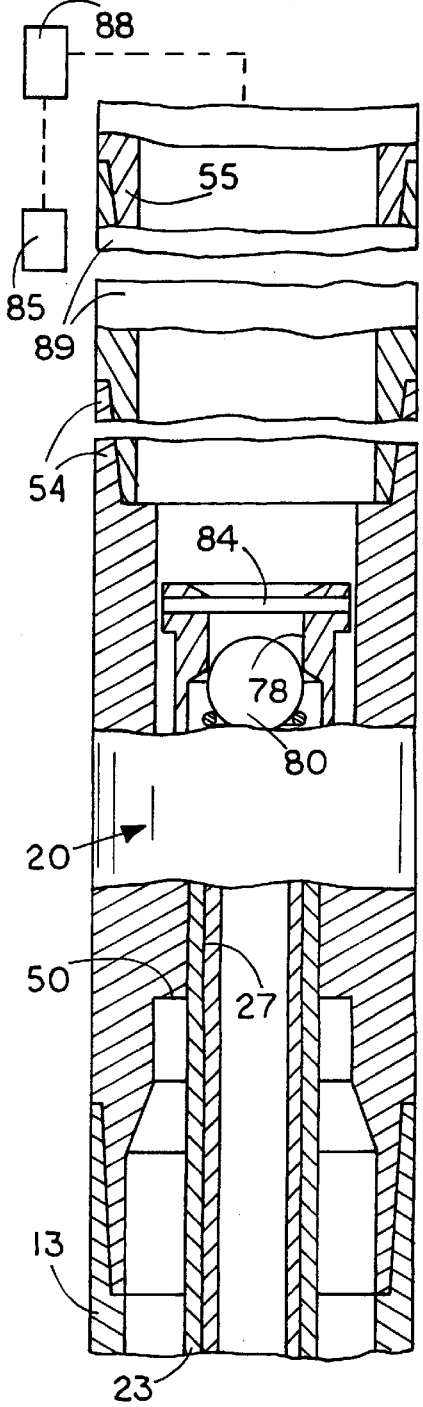
FIG. 8 is in part a fragmentary view of the safety sub and the outer end portion of the overshot assembly and overshot adaptor and in part a somewhat diagrammatic showing of a water swivel and drill rods extending axially outwardly of the safety sub, portions being shown in cross section and axial intermediate portions being broken away.

Referring now in particular to FIGS. 1A, 1B and 6, there is illustrated an overshot assembly, generally designated 10, in a hollow drill string 13 which is made up of a series of interconnected hollow drill rods (tubes). Even though the drilling direction is not shown as being upwardly, the drill string 13 is in an upwardly extending bore hole 12 drilled in rock or other types of earth formations by means of an annular core bit 11 which is at a higher elevation than the axial outer end of the drill string. The pump apparatus located at the drilling surface and indicated by block 85 pumps fluid under pressure through a conventional water swivel 88 and into a safety sub, generally designated 20, which is removably mounted to the outer end of the drill string 13. The bit in the bore hole 12 may be at a considerable elevation above the drilling surface but at a considerable depth below the earth surface.

The overshot assembly includes a pair of axially elongated pulling dogs 14 having their intermediate portions pivotally mounted in a slot in the overshot main body 16 by a pivot pin 15. The outer end portions 14B of the dogs are resiliently urged transversely away from one another by a spring 18 mounted on studs 17 that are joined to the dogs (see FIG. 6). The movement of the dog jaws 14A at the inner end portions of the dogs toward one another is limited by a pin 19 mounted to the main body and extending between the dogs inwardly of the pivot pin 15.

Figure 2:
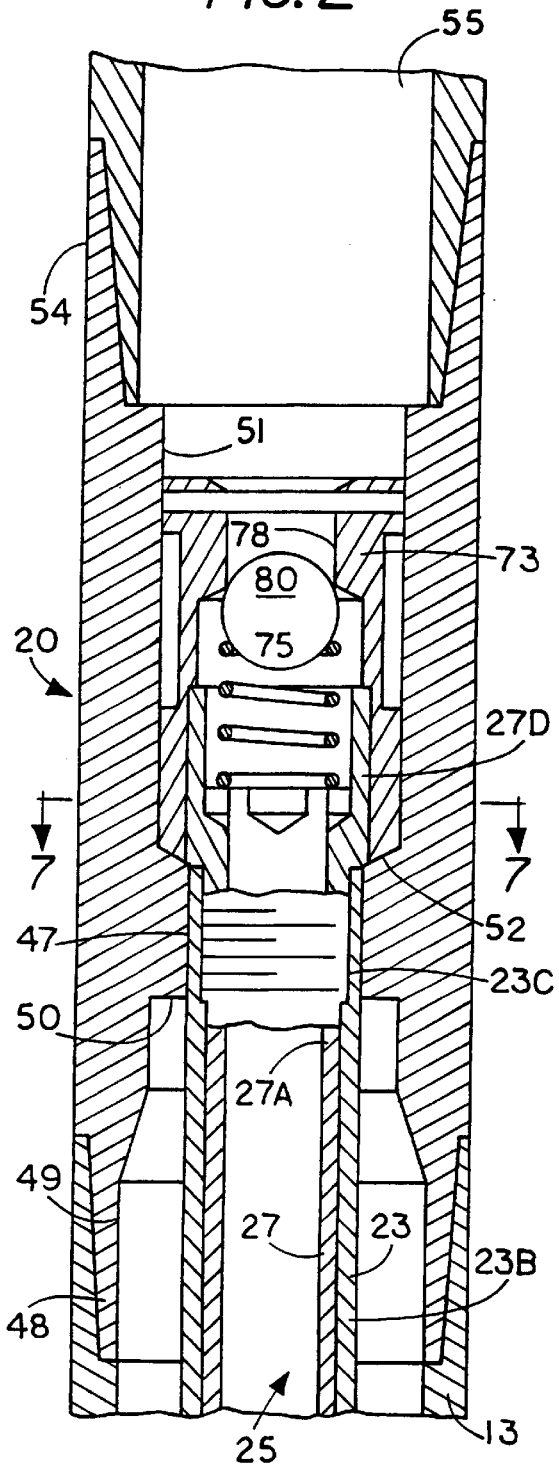
FIG. 2 is an enlarged, fragmentary longitudinal sectional view of the outer end portion of the structure shown in FIG. 1A.
Figure 3:
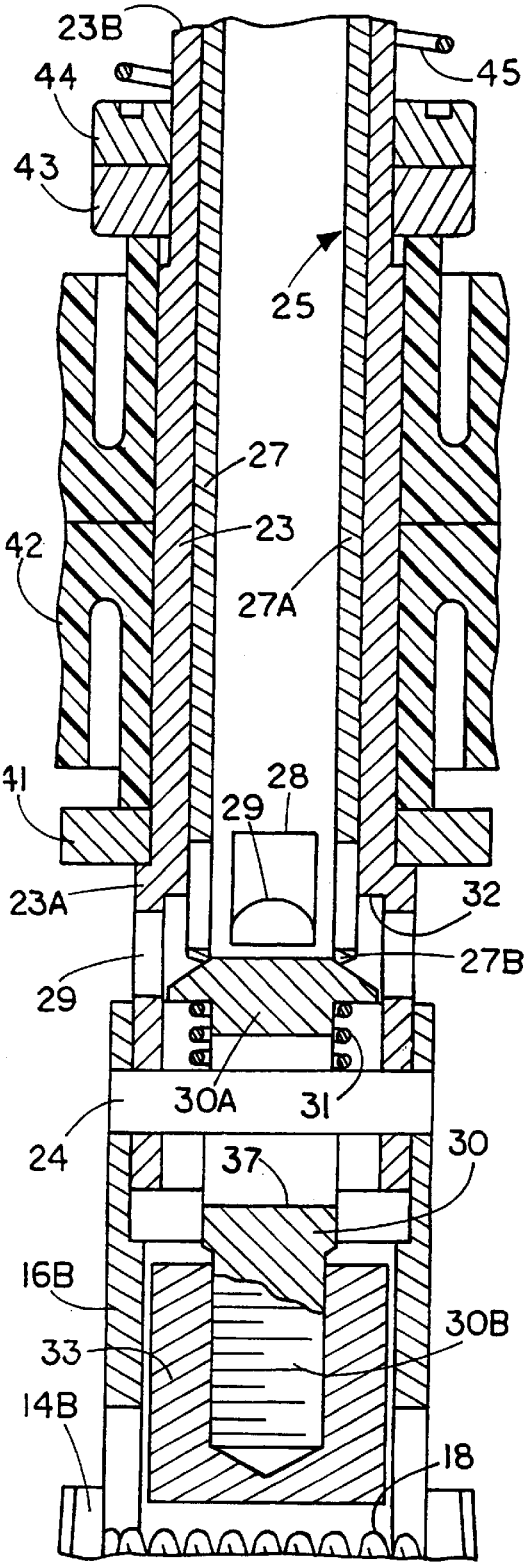
FIG. 3 is a further enlarged, fragmentary longitudinal sectional view of an axial intermediate portion of the structure of FIGS. 1A and 1B.

Referring in particular to FIG. 3, the enlarged inner and outer diameter inner end portion 23A of the axially elongated overshot tube 23 is extended into the tubular outer end portion 16B of the main body and secured thereto by a pin 24. The outer end portion 23B of the overshot tube is internally threaded at 23C to have the outer end portion of the reduced diameter tubular portion 27A of adaptor tube 27 of the overshot adaptor, generally designated 25, threaded thereto (see FIG. 2).

The adaptor tubular portion 27A has a plurality of ports 28 closely adjacent to its inner annular edge 27B which opens to the annular clearance space radially between the outer peripheral wall of the adaptor tubular portion 27A and the peripheral wall of the overshot tubular portion 23A. The overshot tubular portion 23 has ports 29 that open to the above mentioned clearance space axially outwardly of the main portion 23A. There is a valve member 30 having a head portion 30A that is resiliently urged by a spring 31 to a closed position to abut against the inner annular edge portion 27B of the adaptor tube 27 when threaded to the overshot tube, the spring acting between the head portion and the pin 24. Further, when the adaptor tube is not threaded to the overshot tube, spring 31 resiliently urges the valve member to a closed position abutting against valve seat 32 and permits the valve member being moved to an open position by fluid under pressure being exerted on the valve member in an inward direction.

The valve member has a valve stem 30B with an elongated slot 37 through which pin 24 extends to mount the valve member to the main body for limited relative axial movement. When the adaptor tube 27 is moved outwardly relative to the main body 16, the valve member is resiliently moved to have the head portion 30A abut against the valve seat 32 formed at the juncture of the bore portions of the enlarged diameter portion 23A and the reduced diameter portion 23B to block fluid flow between ports 29 and the adjacent part of reduced diameter tubular portion 23B and axially outwardly (see FIG. 6). A dog retainer 33 is mounted to the inner end portion of the valve stem to move therewith in the main body tubular portion 16B between a position extending between the outer ends of dogs to block the pulling dogs jaws spreading apart to a release position to allow the spear point 35A of an overshot coupling member 35 of a drilling tool, generally designated 40, move sufficiently axially inwardly between the jaws for being coupled to the overshot coupling member when the valve head abuts against the adaptor tube 27 and a position allowing the jaws spreading to allow the overshot assembly be coupled to the overshot coupling member when the valve member abuts against the valve seat 32 such as shown in FIG. 6. The tool may be any one of, for example, a core barrel inner tube, one having a plug bit, an earth sampling tube etc. The tool may be of a type fluidly propellable to the bit end of the drill string, for example the core barrel inner tube assembly of FIGS. 3A, 3B, 4A, 4B of U.S. Pat. No. 5,934,393 and FIG. 13 of U.S. Pat. No. 5,257,620.

The overshot assembly also includes an annular retainer 41 with the reduced diameter tubular portion 23B extended therethrough and abutting against the outwardly facing shoulder formed at the juncture of tubular portion 23B with enlarged diametric portion 23A of the overshot tube. The tubular portion 23B also extends through the annular, resilient fluid seal members 42. Each seal member has an outer peripheral cylindrical surface portion to at least substantially form a fluid sealing fit with the inner peripheral wall of the drill string as the overshot assembly moves axially inwardly in the drill string. Advantageously, each of the fluid seals 42 are of a construction the same as or similar to the seal member E of the inner tube assembly of U.S. Pat. No. 5,934,393 that forms a fluid seal with the drill string and thus will not be further described. The fluid seal members 42 block fluid flow bypassing the overshot assembly through the clearance space between the overshot tube 23 and the inner peripheral wall of the drill string. The seal members are retained between the annular member 41 and a seal nut 43 that is threaded on the tubular portion 23B while a retainer nut 44 is also threaded on the tubular portion 23A to abut against the annular member 41. The overshot tube 23 has an axial intermediate portion extended through a coil spring 45, the inner end of the spring 45 being mounted to the retainer nut to extend outwardly thereof.

Referring to FIG. 2, the safety sub 20 is tubular and has an axial intermediate, minimum diameter bore portion 47 of a diameter to have the reduced diameter overshot tube portion 23B slidably extended therethrough. The sub includes an axial inner male pin 48 for being threaded to the outer end of the drill string 13 and has an axial bore portion 49 that at its minimum diameter part is of a larger diameter than that of bore portion 47 and opens to bore portion 47 to provide an axial inner facing shoulder 50. The outer end of bore portion 47 opens to a larger diameter bore portion (valve chamber) 51 to provide an outwardly facing shoulder 52 while the opposite end of the bore portion 51 opens to a larger diameter box portion 54 to provide an outwardly facing shoulder. The male pin portion 55 of either a conventional water swivel 88 or the male pin portion 58 of a loading chamber 57 are threadedly connectable to the box portion 54.

Figure 4:
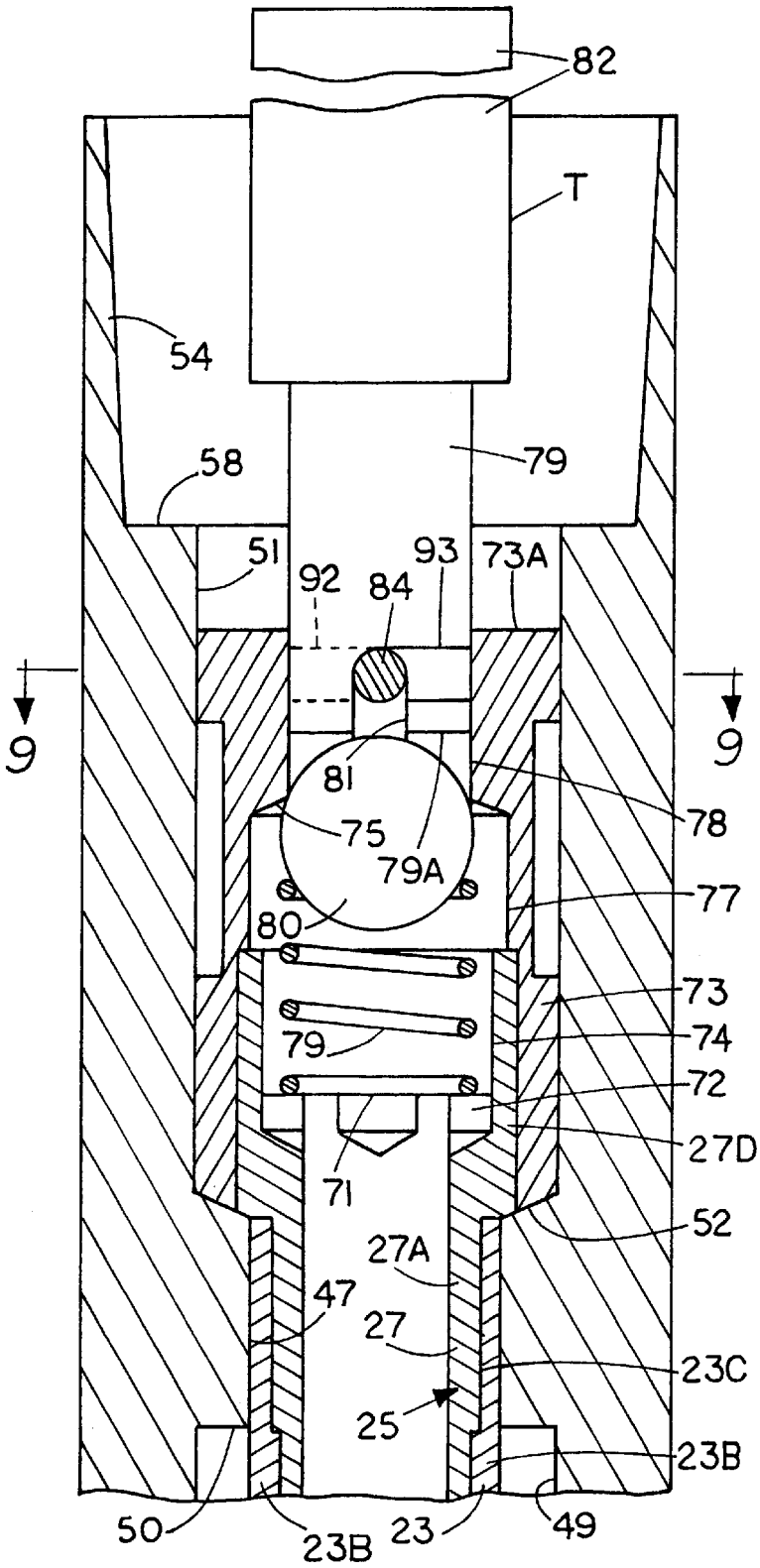
FIG. 4 is an enlarged longitudinal cross sectional view of the outer end portion of the structure of FIG. 1A together with a disconnect tool shown in a position for being rotated and then pulling the combination of an overshot adaptor and an overshot assembly to extend outwardly of the safety sub.
Figure 5:
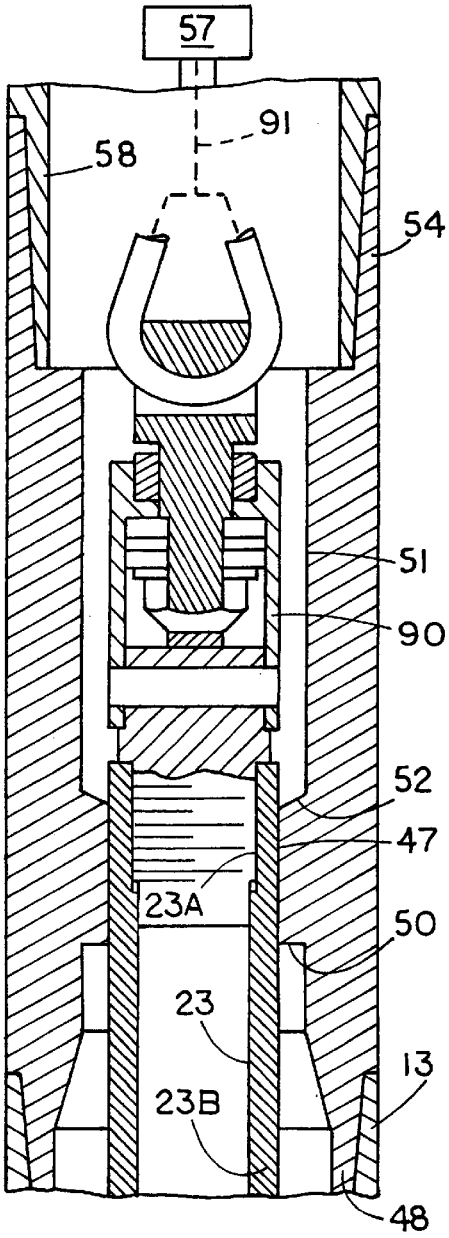
FIG. 5 is a longitudinal cross sectional view showing the wire line adaptor threaded to the overshot assembly tube with the overshot assembly extending within the safety sub.

Referring to FIG. 4, a valve body (adaptor head) 73 has an axial inner, enlarged bore portion 77 opening to the head portion bore 74 of the head portion 27D of the adaptor tube 27 and an axial outer reduced diameter bore portion 78 opening to bore portion 77 to provide a valve seat 75. One end of a coil spring 79 is seated against the head portion shoulder 71 and the opposite end abuts against the valve ball 80 to resiliently retain it against the valve seat to block axial outward flow from the adaptor tube 27 to bore portion 78.

The adaptor tube 27 includes an axial outer, annular head portion 27D having a bore 74 of a larger inner diameter than the inner diameter of the bore of tubular portion 27A of adaptor tube 27 and opens thereto to provide an outwardly facing shoulder 71 with a plurality of holes 72 opening to the shoulder and the bore portion of tubular portion 27A. The head portion has external threads for being threaded to the internally threaded inner end portion of the valve body 73, the outer diameter of each of the head portion and the valve body being greater than the diameter of sub bore portion 47 whereby the head portion and valve body are abuttable against shoulder 52 to limit the axial inward movement of the overshot adaptor relative to the sub. Further, the valve body is of a lesser axial length than the length of the chamber 51. Thus, when the valve body is abutting against shoulder 52, the outer transverse surface 73A of the valve body is a significant distance inwardly of the shoulder 58. Intermediate the valve seat 75 and surface 73A, a pin 84 is mounted to the valve body to extend diametrically across bore portion 78.

Figure 9:
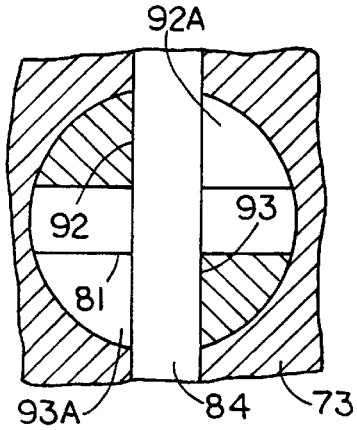
FIG. 9 is a fragmentary view generally taken along the line and in the direction of the arrows 9—9 of FIG. 4 other than the tool has been rotated 90 degrees.
Figure 10:
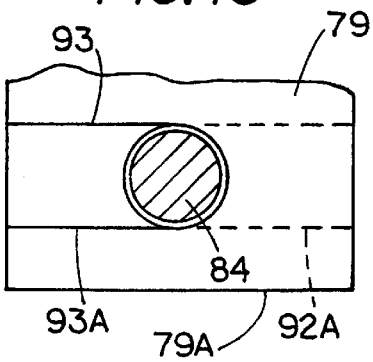
FIG. 10 is a fragmentary longitudinal view of the tool in the rotated position of FIG. 9.

In order to facilitate moving the overshot adaptor outwardly of the box portion 54 sufficiently to provide easy access for separating the overshot adaptor from the overshot assembly, there is provided a disconnect tool T that has an axial outer handle portion 82 and a reduced diameter, axial inner rod portion 79 of a diameter to be extendable into the valve body bore portion 78. The axial inner part of the rod portion has a slot 81 that extends diametrically thereacross and opens through its inner transverse surface 79A. Further, the rod portion has diametrically opposite cutouts 92, 93 axially outward of the transverse surface and open to the rod peripheal surface and to the outer end of the slot 81 in the same angular direction whereby when the rod portion is moved axially inwardly to have the pin 84 abut against the outer end of the slot 81 the rod can be rotated about 90 degrees to have the axial inner transverse surfaces 92A, 93A of the cutouts abuttable against the pin 84. As a result, with the water swivel 85 or other structure extending outwardly of the box portion 55 separated from the safety sub, the tool rod portion 79 can be moved into bore portion 78 to have the pin 84 extend into the outer end of slot 81 (see FIG. 4) and then the tool rotated to have the pin located in the closed end portions of the cutouts 92, 93 that extend about 90 degrees relative to slot 81 (see FIG. 9). Now, upon moving the tool axially outwardly, the overshot adaptor, together with the overshot assembly, is moved sufficiently axially outwardly relative to the safety sub whereby the overshot adaptor can be separated from the overshot assembly.

In use, with the overshot adaptor separated from the overshot assembly and the safety sub, the outer end portion of the overshot tube 23 is extended through the sub bore portion 49 and into bore portion 47 to extend axially outwardly of the sub. The axial inner end of the adaptor tube is extended into the outer end portion of the overshot tube 23 and threaded to form a threaded connection at 23C. As the overshot adaptor is extended into and threadedly connected to the overshot assembly, the adaptor tube 27 forces the valve member 30 inwardly against the action of spring 31 whereby the dog retainer 33 is moved between the outer ends of the pulling dogs to prevent the jaws 14A spreading apart sufficiently to slip over the spear point 35A and couple to the overshot coupling member 35. Now, the axial inward movement of the threaded combination of the overshot adaptor and the overshot assembly relative to the safety sub is limited by the valve body abutting against the shoulder 52 while the axial outward movement is limited by spring 45 abutting against shoulder 50.

After the core barrel inner tube assembly 40 or similar drilling tool is inserted into the outer end of the drill string 13, the inner end portion of the combination of the overshot assembly and overshot adaptor is inserted into the drill string, pushing the drilling tool 40 inwardly and then the safety sub is threaded to the outer end of the drill string. Thence, the water swivel 88 is threaded to the safety sub to which a supply of fluid under pressure 85 is attached. In the event the drilling direction is upwardly, the drilling tool is of a conventional type that can be fluidly propelled in the drill string adjacent to the bit end 11. If the drilling tool is an underground wire line core barrel inner tube assembly, one example being that of FIGS. 3A and 3B U.S. Pat. No. 5,934,393, fluid under pressure forces the valve ball 80 off the valve seat to allow fluid to flow through a bypass channel, i.e. through tube 27 and through ports 28, 29 to the annular clearance space between the overshot main body and the drill string to bypass fluid seals 42 and force the inner tube assembly inward until its core lifter 34 is located adjacent to the bit opening through which the core being drilled extends.

After the inner tube assembly is at the bit end of the drill string, drill fluid is pumped into the drill string and the drill string rotated to drill a core. In the event the core barrel (not shown) of the inner tube assembly is of an extended type or the core barrel is longer than the drill rods being used, during the drilling operation, pumping of fluid under pressure is discontinued whereby the valve ball 80 is resiliently moved to prevent axial outward flow in the drill string, rotation of the drill string stopped, and then the water swivel removed. Now an additional drill rod(s) 89 may be threadedly connected to the box portion of the sub and thence the water swivel 88 threaded to the outer end of said additional drill rod(s). Thereafter, fluid under pressure is pumped into said additional drill rod which forces the valve ball 80 to move inwardly and the drill string rotated to continue the core taking operation.

When the core receiving tube (not shown) is filled, rotation of the drill string is stopped and the pumping in of fluid is discontinued together with removing the water swivel and removing drill rods, if any, extending outwardly of the safety sub. Since the valve ball 80 seats on the valve seat, fluid flow axially outwardly through the overshot adaptor overshot assembly is blocked. Using the disconnect tool T, the overshot adaptor overshot assembly combination is pulled outwardly in a manner previously indicated to have the outer end portion thereof extend outwardly of the sub box portion. Thence the overshot adaptor is unthreaded from the overshot assembly and withdrawn therefrom. As the overshot adaptor is unthreaded from the overshot assembly and moves axially outwardly relative thereto, the valve member 30 is resiliently moved outwardly to abut against the valve seat 32 to block fluid flow from inwardly of the seals 42 and then through the ports 29 and into tubular portion 23B, the valve member blocking axial outward flow through the bypass channel provided by the overshot tube and ports 29. Desirably, the axial length of the threaded connection 23C is sufficiently great that prior to the overshot adaptor being completely unthreaded from the overshot assembly, the valve member 30 seats against the valve seat 32. During the separation of the overshot adaptor from the overshot assembly, the axial outward movement of the overshot assembly relative to the sub is limited by the spring 45 abutting against shoulder 50. Accordingly, time is not lost in having to drain the drill string and insert an overshot assembly into the drill string since the overshot assembly is already extending within the drill string and water or other drilling fluid in the drill string is not drained from the drill string.

After the overshot adaptor is removed and while the overshot tube portion is extending outwardly of the sub box portion, the wire line swivel (wire line adaptor) 90 with a wire line 91 connected thereto is threadedly connected to the overshot tube threaded portion 23C. The male pin 58 of the loading chamber or stuffing box 57 is threadedly connected to the sub box portion 54 and fluid under pressure is connected to the loading chamber and pumped into the drill string to fluidly propel the overshot assembly to the drilling tool 40 and upon the pulling jaws encountering the spear point 35A, the jaws are pivoted to their release position to allow the spear point pass therebetween and then the pulling dogs are resiliently urged to their coupling position to couple to the overshot coupling member 35. It is noted that during the unthreading of the overshot adaptor from the overshot assembly, the dog retainer 33 moves axially outwardly of the pulling dogs and as a result the dogs may pivot to move axially inwardly of the spear point 35A to couple thereto.

After the overshot assembly has coupled to the drilling tool 40 and the discontinuance of the application of fluid under pressure to the drill string, the wire line is retracted whereby the drilling tool 40 is unlatched from the drill string, if latched thereto, and the drilling tool and overshot assembly are moved to have the coil spring abut against the shoulder 50. If the drilling tool is retracted with the overshot assembly, the spring 45 is further compressed and the overshot assembly extends further outwardly of the sub than the extent of protrusion after the overshot adaptor had been disconnected from the overshot assembly and no external force was applied to the overshot assembly. This can be seen upon removing the loading chamber from the sub. Only after the operator is certain that the drilling tool 40 has been retracted with the overshot assembly, the loading chamber 57 and then the safety sub can be safely removed from the drill string and thereafter the overshot assembly and the drilling tool removed from the drill string. In the event it does not appear that the overshot assembly has retracted the drilling tool and more than one attempt is made by pumping the overshot assembly inwardly in an attempt to retract the drilling tool, greater precautions have to be taken in removing the sub. The above assumes the drilling direction is upwardly.

What is claimed is:

1. A drilling apparatus, which is fluidly propellable axially inwardly in a drill string from the drill string outer end to a position to couple to a drilling tool at the drill string bit end and retractable axially outwardly by a wire line, comprising:

(a) an axially elongated overshot main body having an outer end portion, (b) a pair of pulling dogs having axial outer end portions, axial intermediate portions and axial inner jaws for releasably coupling to the drilling tool, (c) means for pivotally mounting the pulling dogs to the main body for movement between a drill tool coupling position and an overshot release position, (d) an axially elongated overshot member having an outer end portion, an axial intermediate portion and an inner end portion mounted to the main body outer end portion to extend axially outwardly thereof, (e) annular means mounted to the axial intermediate portion of the overshot member for forming a fluid seal between the drill string and the overshot member, (f) at least one of the overshot member and the main body having a fluid bypass channel to bypass the means for forming a fluid seal, (g) at least one of the overshot member and the main body having a valve seat through which the bypass channel extends, (h) a valve member mounted to at least one of the main body and the overshot member for limited movement between a closed position blocking fluid flowing through the valve seat and axially outwardly through the bypass channel and an open position, and (i) means for resiliently urging the valve member to its closed position while permitting the valve member being moved to its open position by fluid under pressure being exerted on the valve member in an inward direction.

2. The drilling apparatus of claim 1 wherein:

a wire line swivel is mountable to the overshot member outer end portion to block the bypass channel and facilitate withdrawing the overshot assembly through the drill string.

3. A drilling apparatus, which is fluidly propellable axially inwardly in a drill string from the drill string outer end to a position to couple to a drilling tool at the drill string bit end and retractable axially outwardly by a wire line, comprising:

(a) an axially elongated overshot main body having an outer end portion, (b) a pair of pulling dogs having axial outer end portions, axial intermediate portions and axial inner jaws for releasably coupling to the drilling tool, (c) means for pivotally mounting the pulling dogs to the main body for movement between a drill tool coupling position and an overshot release position, (d) an axially elongated overshot member having an outer end portion, an axial intermediate portion and an inner end portion mounted to the main body outer end portion to extend axially outwardly thereof, (e) annular means mounted to the axial intermediate portion of the overshot member for forming a fluid seal between the drill string and the overshot member, (f) at least one of the overshot member and the main body having a fluid bypass channel to bypass the means for forming a fluid seal, (g) at least one of the overshot member and the main body having a valve seat through which the bypass channel extends, (h) a valve member mounted to at least one of the main body and the overshot member for limited movement between a closed position blocking fluid flowing through the valve seat and axially outwardly through the bypass channel and an open position, (i) means for resiliently urging the valve member to its closed position while permitting the valve member moving to its open position when fluid under pressure is exerted on the valve member in an inward direction, (j) a retainer member mounted to the valve member to move therewith to extend between the pulling dogs outer end portions to block the pulling dogs moving to their drilling tool coupling position when the valve member is in its open position and permit the pulling dogs moving to their drilling tool coupling position when the valve member is in its closed position, and (j) an overshot adaptor removably mounted to the overshot member, (k) the overshot member being an overshot tube having an inner end portion opening through the valve seat and an outer end portion, and (l) the overshot adaptor includes an adaptor tube extendable into the overshot tube to abut against the valve member to retain the valve member in its open position, the adaptor tube having an outer end portion and an inner end portion, and means mounted to the adaptor tube outer end portion and resiliently retained in a position for blocking axial outward fluid flow through the adaptor and overshot tubes while permitting flow fluid under axial inward pressure through the adaptor tube.

4. The drilling apparatus of claim 3 wherein there is:

(a) a safety sub having an inner end portion adapted for being removably mounted to the drill string outer end, an outer end portion and an axial intermediate reduced diameter bore portion that opens to the sub inner end portion to provide an axially inwardly facing first shoulder and to the sub outer end portion to provide an axially outwardly facing second shoulder, (b) at least the outer end portion of the overshot tube being of a diameter to extend through the sub reduced diameter portion, and (c) the means for blocking axial outward flow has an outer diameter part larger than the reduced diameter bore portion to provide a shoulder seatable on the second shoulder to limit the axial inward movement of the adaptor tube through the sub reduced diameter bore portion.

5. The drilling apparatus of claim 4 wherein:

the annular means for forming a fluid seal is of a maximum outer diameter that is greater than the diameter of the sub reduced diameter bore portion.

6. The drilling apparatus of claim 4 wherein:

the means for resiliently urging the valve member is mounted to the overshot tube axially outwardly of the means for forming a fluid seal for abutting against the first shoulder to limit the axial outward movement of the overshot tube through the sub reduced diameter bore portion.

7. The drilling apparatus of claim 4 wherein:

(a) the overshot tube outer end portion has an internally threaded part, (b) the adaptor tube outer end portion has an external threaded end portion for being threaded to the overshot tube threaded part for mounting the overshot adaptor to the overshot member, and (c) there is provided a wire line adaptor that is threadedly connectable to the overshot tube threaded part after the overshot adaptor is removed from the overshot member.

8. The drilling apparatus of claim 4 wherein:

(a) the outer diameter part of the means for blocking fluid flow is a head portion providing a valve chamber and a second valve seat opening axially inwardly, (b) the means for blocking fluid flow includes a second valve member in the valve chamber and means for resiliently urging the second valve member against the second valve seat to block axial outer flow through the second valve seat, and (c) the head portion being removably threaded to the adaptor tube outer end portion and being seatable on the second shoulder to for limiting the axial inward movement of the adaptor tube.

9. The drilling apparatus of claim 8 wherein, when the head portion seats on the second shoulder:

(a) the safety sub extends outwardly of the overshot adaptor, (b) the head portion has an axial outer, reduced diameter bore part to which the second valve seat opens and a pin extends diametrically across the head bore part, and (c) there is provided a disconnect tool having a handle and axial inner means extendable into the head reduced bore part for cooperating with the pin to pull the overshot adaptor and overshot assembly axially outward to extend at least in part outwardly of the sub outer end portion.

10. The drilling apparatus of claim 9 wherein there is provided:

means on one of the main body and the overshot tube to limit the axial outward movement of the overshot tube relative to the safety sub when the disconnect tool moves the overshot adaptor and overshot assembly axially outwardly.

11. A drilling apparatus, which is mountable to the outer end of a drill string that has an axial inner bit end, comprising:

(a) an overshot adaptor and (b) an overshot assembly fluidly propellable axially inwardly in the drill string from the drill string outer end to a position to couple to a drilling tool at the drill string bit end and is retractable axially outwardly by a wire line, (c) the overshot assembly including an axially elongated overshot main body having an axial outer end portion and an axial inner end portion, a pair of pulling dogs having axial outer ends, axial intermediate portions and axial inner jaws for releasably coupling to the drilling tool, means for mounting the pulling dogs to the main body for movement between a drill tool coupling position and an overshot release position, an axially elongated overshot tube having an outer end portion, an axial intermediate portion and an inner end portion mounted to the main body outer end portion to extend axially outwardly thereof, annular means mounted to the axial intermediate portion of the overshot tube for forming a fluid seal between the drill string and the overshot tube, a valve seat in one of the overshot tube and the main body outer end portion and a port opening to the overshot tube and radially outwardly axially inwardly of each of the valve seat and the means for forming a fluid seal, a valve member mounted by at least one of the main body and the overshot tube, means for mounting the valve member for movement between a closed position blocking fluid flow through the valve seat and an open position, and means for resiliently retaining the valve member in its closed position, and (d) the overshot adaptor being removably threaded to the overshot tube and having an adaptor tube extending into the overshot tube when the overshot adaptor is threaded to the overshot tube for retaining the valve member in its open position and permitting the valve member moving to its closed position when the adaptor tube is withdrawn from extending within the overshot tube.

12. The drilling apparatus of claim 11 wherein:

(a) the overshot adaptor has an axial inner port, and (b) the overshot tube has a port opening to the adaptor port and radially therethrough inwardly of the valve seat and the means for form a fluid seal.

13. The drilling apparatus of claim 12 wherein:

the overshot adaptor includes a valve body joined to the adaptor tube to extend outwardly thereof and having a valve seat and means in the valve body for blocking axial outward fluid flow from the adaptor tube and through the valve body.

14. A drilling apparatus, which is usable with drilling tool and a drill string having an axial outer end and an axial inner bit end, comprising:

(a) an annular safety sub having an axial inner annular end portion adapted for being threadedly connectable to the drill string outer end, an annular outer end portion and an axial intermediate reduced diameter bore portion of a smaller inner diameter than the inner diameter of the sub inner annular end portion and opening to the sub inner annular end to provide an axially inwardly facing first shoulder and of a smaller inner diameter than that of the sub axial outer end portion and opening thereto to provide an axial outwardly facing second shoulder, (b) an overshot assembly that includes an axially elongated overshot tube having an axial inner end portion and an axial outer end portion of an outer diameter slidably extendable through the reduced diameter portion, a pair of axially elongated pulling dogs having axial outer ends, axial intermediate portions and axial inner jaws, and means mounted to the overshot tube inner end portion for mounting the pulling dogs for movement between a drilling tool coupling position and a drilling tool release position and (c) an overshot adaptor removably connected to the overshot assembly, the overshot adaptor having an axial inner adaptor tube extendable into the overshot tube and an axial outer head portion joined to the adaptor tube and abuttable against the second shoulder for limiting the axial inward movement of the overshot assembly relative to the sub, (d) the overshot assembly including means abuttable against the first shoulder for limiting the movement of the overshot assembly and the overshot adaptor axially outwardly relative to the safety sub.

15. The drilling apparatus of claim 14 wherein:

the overshot assembly includes means mounted on the overshot tube for forming a fluid seal between the overshot tube and the drill string.

16. The drilling apparatus of claim 15 wherein:

the overshot adaptor and the overshot assembly when mounted one to the other have a fluid bypass channel that opens axially outwardly of the means for forming a fluid seal and opens axial inwardly of the means for forming a fluid seal and means for blocking fluid flow through the bypass channel in one axial direction while permitting fluid under pressure flowing through the bypass channel in the opposite axial direction.

17. The drilling apparatus of claim 16 wherein:

(a) the fluid bypass channel opens axially outwardly through the head portion, and (b) the means blocking fluid flow is in part defined by a valve seat in the adaptor head portion, a valve member in the head portion movable between an axial outer closed position blocking axial outward fluid flow through the bypass channel and an open position under axial inner fluid pressure and means in the head portion for resiliently urging the valve member to its closed position.

18. The drilling apparatus of claim 16 wherein:

(a) the overshot tube includes an axially elongated, axial outer tubular portion and an axial inner tubular portion opening to the axial outer tubular portion to form said valve seat, the axial inner portion having a port inwardly of valve seat and the means for forming a fluid seal, and (b) the adaptor tube has an axial inner portion abuttable against the valve member to retain the valve member in its open position and a port in fluid communication with the overshot tube port when the overshot adaptor is mounted to the overshot assembly.

19. The drilling apparatus of claim 16 wherein the drilling tool is a wire line core barrel inner tube assembly and:

the means for limiting the movement of overshot assembly and overshot adaptor comprises a spring mounted to the overshot tube axially outwardly of the means for forming a fluid seal to have the overshot tube extend therethrough.

20. A drilling apparatus, which is usable with a drilling tool and a drill string having an axial outer end and an axial inner bit end, comprising:

(a) an annular safety sub having an axial inner annular end portion adapted for being threadedly connectable to the drill string outer end, an annular outer end portion and an axial intermediate reduced diameter bore portion of a smaller inner diameter than the inner diameter of the inner annular sub end portion and opening to the inner annular sub end portion to provide an axially inwardly facing shoulder and of a smaller inner diameter than that of the axial outer sub end portion and opening thereto to provide an axial outwardly facing second shoulder, (b) an overshot assembly that includes a main body, a pair of axially elongated pulling dogs having axial outer ends, axial intermediate portions and axial inner jaws, means mounted to the main body for mounting the pulling dogs for movement between a drilling tool coupling position and a drilling tool release position and annular means for sealingly engaging the drill string and (c) an overshot adaptor removably connected to the overshot assembly for limiting the movement of the overshot assembly inwardly relative to the sub, (d) the overshot adaptor and overshot assembly having cooperating means extending axially through the means for sealingly engaging the drill string for forming a fluid bypass channel to permit axial inwardly flow bypassing the means for sealingly engaging the drill string when the overshot adaptor is mounted to the overshot assembly while blocking axial outward fluid flow bypassing the means for sealingly engaging the drill string, said cooperating means extending axially through the means for sealingly engaging the drill string, (e) the overshot assembly having means abuttable against the first shoulder to limit the axial outward movement relative to the sub.

21. The drilling apparatus of claim 20 wherein there is provided:

(a) a wire line adaptor having a threaded portion, (b) the cooperating means includes an axially elongated overshot tube that at least in part defines the fluid bypass channel and a valve seat, means seatable against the valve seat for blocking axial outward flow therethrough and means for resiliently urging the means to block fluid flow to seat against the valve seat, and (c) the overshot tube having an axial outer threaded portion for having the wire line adaptor connected thereto for retracting the overshot assembly and blocking the fluid bypass channel when the overshot adaptor is disconnected from the overshot assembly.

22. In a drilling operation, the steps of:

(a) inserting a drilling tool into the outer end of a drill string, (b) then mounting an overshot adaptor, an overshot assembly and a safety sub in combination to the drill string outer end with the overshot assembly extending in the drill sting outer end to prevent the drilling tool moving outwardly of the drill string, (c) pumping fluid under pressure axially inwardly through the overshot adaptor and overshot assembly while retaining the overshot adaptor and overshot assembly at the drill string outer end and (d) preventing axial outward flow through the drill string when the pumping in of fluid is discontinued, (e) then after discontinuing the pumping in fluid, separating overshot adaptor from the overshot assembly while leaving the overshot assembly extending within the drill string outer end, (f) next attaching a wire line adaptor to the overshot assembly while the overshot assembly is still extending within the drill string, (g) thence pumping fluid under pressure into the drill string to fluidly propel the overshot assembly inwardly in the drill string to couple to the drilling tool, and thereafter.

(h) retracting overshot assembly.

23. A drilling apparatus, which is fluidly propellable axially inwardly in a drill string from the drill string outer end to a position to couple to a drilling tool at the drill string bit end and retractable axially outwardly by a wire line, comprising:

(a) an axially elongated overshot main body having an outer end portion, (b) a pair of pulling dogs having axial outer end portions, axial intermediate portions and axial inner jaws for releasably coupling to the drilling tool, (c) means for pivotally mounting the pulling dogs to the main body for movement between a drill tool coupling position and an overshot release position, (d) an axially elongated, tubular overshot member having an outer end portion, an axial intermediate portion and an inner end portion mounted to the main body outer end portion to extend axially outwardly thereof, (e) annular means mounted to the axial intermediate portion of the overshot member for forming a fluid seal between the drill string and the overshot member, (f) at least one of the overshot member and the main body having a fluid bypass channel to bypass the means for forming a fluid seal, (g) at least one of the overshot member and the main body having a valve seat through which the bypass channel extends, (h) a valve member mounted to at least one of the main body and the overshot member for limited movement between a closed position blocking fluid flowing through the valve seat and axially outwardly through the bypass channel and an open position, (i) means for resiliently urging the valve member to its closed position while permitting the valve member moving to its open position when fluid under pressure is exerted on the valve member in an inward direction, (j) a retainer member mounted to the valve member to move therewith to extend between the pulling dogs outer end portions to block the pulling dogs moving to their drilling tool coupling position when the valve member is in its open position and permit the pulling dogs moving to their drilling tool coupling position when the valve member is in its closed position, and (k) an overshot adaptor removably mounted to the overshot member and having a tubular portion extendable into the overshot member to abut against the valve member to retain it in its open position and form a part of the bypass channel.

24. A drilling apparatus, which is fluidly propellable axially inwardly in a drill string from the drill string outer end to a position to couple to a drilling tool at the drill string bit end and retractable axially outwardly by a wire line, comprising:

(a) an axially elongated overshot main body having an outer end portion, (b) a pair of pulling dogs having axial outer end portions, axial intermediate portions and axial inner jaws for releasably coupling to the drilling tool, (c) means for pivotally mounting the pulling dogs to the main body for movement between a drill tool coupling position and an overshot release position, (d) an axially elongated overshot member having an outer end portion, an axial intermediate portion and an inner end portion mounted to the main body outer end portion to extend axially outwardly thereof, (e) means for forming a fluid seal between the drill string and the overshot member, the last mentioned means being annular and mounted to the axial intermediate portion of the overshot member, (f) at least one of the overshot member and the main body having a fluid bypass channel to bypass the means for forming a fluid seal, (g) at least one of the overshot member and the main body having a valve seat through which the bypass channel extends, (h) a valve member mounted to at least one of the main body and the overshot member for limited movement between a closed position blocking fluid flowing through the valve seat and axially outwardly through the bypass channel and an open position, (i) means for resiliently urging the valve member to its closed position while permitting the valve member being moving to its open position by fluid under pressure being exerted on the valve member in an inward direction, and (j) a retainer member mounted to the valve member to move therewith to extend between the pulling dogs outer end portions to block the pulling dogs moving to their drilling tool coupling position when the valve member is in its open position and permit the pulling dogs moving to their drilling tool coupling position when the valve member is in its closed position.

* * * * *